US006202572B1

(12) United States Patent
Case

(10) Patent No.: US 6,202,572 B1
(45) Date of Patent: Mar. 20, 2001

(54) EXHAUSTER FOR A SOLID FUEL PULVERIZING AND FIRING SYSTEM HAVING AN IMPROVED FAN ASSEMBLY

(75) Inventor: Jeffrey A. Case, East Granby, CT (US)

(73) Assignee: Alstom Power N.V., Amsterdam (NL)

( * ) Notice: Subject to any disclaimer, the term of this patent is extended or adjusted under 35 U.S.C. 154(b) by 0 days.

(21) Appl. No.: 09/629,526

(22) Filed: Aug. 1, 2000

(51) Int. Cl.[7] ..... F23K 3/00
(52) U.S. Cl. ..... 110/104 R; 110/101 R
(58) Field of Search ..... 110/101 R, 106, 110/102, 104 R; 241/60; 415/206, 194, 213 A

(56) References Cited

U.S. PATENT DOCUMENTS

| | | | | |
|---|---|---|---|---|
| 1,898,086 | * | 2/1933 | Frisch | 241/33 |
| 2,117,011 | * | 5/1938 | Pratt | 103/103 |
| 2,967,014 | * | 11/1961 | Pabst | 230/134 |
| 3,205,843 | * | 9/1965 | Bogot | 110/106 |
| 4,841,623 | * | 6/1989 | Rine | 29/525.1 |
| 5,076,758 | * | 12/1991 | Palgrave | 415/214.1 |
| 5,302,115 | * | 4/1994 | Hagar et al. | 431/183 |
| 5,363,776 | * | 11/1994 | Wark | 110/106 |
| 6,004,097 | * | 12/1999 | Wark et al. | 415/206 |
| 6,055,914 | * | 5/2000 | Wark | 110/104 R |

* cited by examiner

*Primary Examiner*—Denise L. Ferensic
*Assistant Examiner*—K. B. Rinehart
(74) *Attorney, Agent, or Firm*—Russell W. Warnock

(57) ABSTRACT

An exhauster is provided having an improved fan assembly for exhausting coal through an exhauster fan housing, the exhauster fan assembly being mountable within the housing on a shaft for rotation about a shaft rotational axis. The housing has an inlet generally aligned with the shaft rotational axis such that coal entering the housing through the inlet contacts the rotating exhauster fan and is redirected thereby along a radial outlet path. The exhauster fan assembly includes a plurality of blades and a hub having an outer surface, a free end, and a bore for receiving therein the free end of the shaft in an orientation in which the free end of the shaft and the free end of the hub are oriented in the same axial direction. The outer surface of the hub is radially outwardly spaced from the bore and the blades are mounted to the outer surface of the hub at uniform angular spacings therearound and project radially outwardly therefrom. The exhauster fan assembly also includes a hub protector assembly having a wear plate and wear plate connector means for connecting the plate to at least one of the free end of the shaft and the free end of the hub. The wear plate has an outer periphery each point of which is at a greater radial spacing from the shaft rotational axis than a corresponding angularly aligned point on the outer surface of the hub, whereby the wear plate fully radially overlies the hub and the shaft to which it is attached, as viewed along the shaft rotational axis.

1 Claim, 6 Drawing Sheets

EXHAUSTER FOR A SOLID FUEL PULVERIZING AND FIRING SYSTEM HAVING AN IMPROVED FAN ASSEMBLY

BACKGROUND OF THE INVENTION

This invention relates to solid fuel pulverizing and firing systems for fossil fuel furnaces of the type, wherein the fossil fuel furnace and a substantial portion of the solid fuel pulverizing and firing system by means of which solid fuel and air is supplied to the fossil fuel furnace, are operated at a predetermined pressure, and more specifically, to an exhauster employable in such solid fuel pulverizing and firing systems for fossil fuel furnaces having an improved fan assembly.

Three basic types of solid fuel pulverizer firing systems find common use. These are the direct-fired system, the semi-direct fired system, and the bin storage system. The simplest and most commonly used of these three systems, and the one to which the present invention is directed, is the direct-fired system win which solid fuel, e.g., coal, is fed in a suitable manner along with hot gases to a pulverizer. The solid fuel is simultaneously ground and dried within the pulverizer. The drying of the solid fuel is effected by the hot gases as the latter sweep through the pulverizer. As the hot gases sweep through the pulverizer they are cooled and humidified by means of the evaporation of the moisture contained in the solid fuel. Often, an exhauster is employed for purposes of removing the hot gases and the entrained fine solid fuel particles, i.e., the solid fuel that has been ground within the pulverizer, from the pulverizer. Moreover, this exhauster, when so employed, is located on the discharge side of the pulverizer and is operative to effect the delivery of the mixture of hot gases and entrained fine solid fuel particles to a fossil fuel furnace. The main advantages of the direct-fired system are simplicity, low cost and maximum safety. To this end, the fine solid particles, which can be subject to spontaneous combustion and thus are considered to be potentially hazardous, go directly to the fossil fuel furnace at high velocities, and thus are not given the opportunity to collect and possibly ignite spontaneously. Accordingly, the direct-fired system can be operated at the maximum temperatures that safety will permit.

One prior art form of such a direct-fired solid fuel pulverizer firing system is depicted in U.S. Pat. No. 3,205, 843 entitled "Pulverized Coal Firing System" in which it is disclosed that solid fuel passes through the inlet chute 23 of the pulverizer 26 on to the rotating bowl 32 thereof. The solid fuel thus admitted to the pulverizer 26 is pulverized therewithin by means of the grinding rollers 36 of the pulverizer 26, which are mounted within the pulverizer housing to provide a grinding action between the grinding rollers 36 and the grinding ring provided on the rotating bowl 32 of the pulverizer 26. Air passes up through the pulverizer 26 between the housing thereof and the rim of the rotating bowl 32 and as the air passes the rotating bowl 32, pulverized solid fuel is entrained in this air with the air-pulverized solid fuel mixture passing up into the classifier 40 of the pulverizer 26, which is located in the upper portion of the pulverizer 26. The classifier 40 is effective to separate the coarse solid fuel fractions and return these fractions to the rotating bowl 32 of the pulverizer for regrinding, while the fines retained in the air stream pass through the outlet 42 of the pulverizer 26, which is located at the upper end of the classifier 40. From this outlet 42 of the pulverizer 26, the air-pulverized solid fuel mixture is conveyed to the inlet of the exhauster 46 via conduit 44. The air-pulverized solid fuel mixture in turn is conveyed from the exhauster 46 to the fossil fuel furnace 10 through the ducts 48.

Another prior art form of an exhauster for a solid fuel pulverizer firing system is depicted in U.S. Pat. No. 5,363, 776 to Wark entitled "Exhauster Inlet Venturi". The Wark '776 patent discloses a known pulverizer exhauster fan assembly 10 having a fan 18 with a plurality of radial fan blades 20 connected to a drive shaft 22 by a spider assembly 24. The drive shaft 22 ends in a hub 23 which is capped by a "cooley cap" radial diverter cap 26.

Although solid fuel pulverizer firing systems constructed in accordance with the teachings of the two issued U.S. patents to which reference has been made heretofore have been demonstrated to be operative for the purpose for which they have been designed, there has nevertheless been evidenced in the prior art a need for such solid fuel pulverizer firing systems to be further improved, and more specifically, a need for the exhauster employed therein to be improved. A limiting factor insofar as the operating efficiency of exhausters is concerned has heretofore been the need to facilitate maintenance particularly on the fan assembly thereof. The need for such maintenance is occasioned principally by the fact that the material which is transported through the exhauster is extremely abrasive. To this end, a need has thus been evidenced in the prior art for a new and improved solid fuel pulverizer firing system, and more specifically for a new and improved exhauster for such solid fuel pulverizer firing systems that would require relatively less maintenance than known exhausters.

Moreover, there has been evidenced in the prior art a need for such a new and improved exhauster for such solid fuel pulverizer firing systems that would further be characterized in a number of additional respects. One such additional characteristic which such a new and improved exhauster for such solid fuel pulverizer firing systems would desirably possess is the capability of achieving therewith an even greater reduction in the amount of erosion to which certain interior surfaces of the exhauster. A further additional characteristic which such a new and improved exhauster for such solid fuel pulverizer firing systems would desirably possess is that the exhauster would be capable of embodying all of the above-enumerated characteristics while yet retaining the existing casing of an exhauster.

It is, therefore, an object of the present invention to provide a new and improved exhauster for use in solid fuel pulverizer firing systems.

It is a further object of the present invention to provide such a new and improved exhauster for solid fuel pulverizer firing systems which is characterized by its reduced need for maintenance as compared to prior art forms of exhausters.

Yet another object of the present invention is to provide such a new and improved exhauster for solid fuel pulverizer firing systems which is characterized in that it is possible therewith to achieve all of the foregoing within the existing casing of an exhauster.

Yet a further object of the present invention is to provide such a new and improved exhauster for solid fuel pulverizer firing systems which is characterized in that use may be made thereof either in retrofit applications or in new applications.

Yet another further object of the present invention is to provide such a new and improved exhauster for solid fuel pulverizer firing systems which is characterized in that it is relatively simple in construction, relatively easy to operate, yet is relatively inexpensive to provide.

SUMMARY OF THE PRESENT INVENTION

In accordance with one aspect of the present invention, there is provided an exhauster for a pulverized solid fuel firing system which requires relatively less maintenance than known exhausters. The exhauster of the present invention includes an improved fan assembly for exhausting coal through an exhauster fan housing, the exhauster fan assembly being mountable within the housing on a shaft for rotation about a shaft rotational axis. The housing has an inlet generally aligned with the shaft rotational axis such that coal entering the housing through the inlet contacts the rotating exhauster fan and is redirected thereby along a radial outlet path.

The exhauster fan assembly includes a plurality of blades and a hub having an outer surface, a free end, and a bore for receiving therein the free end of the shaft in an orientation in which the free end of the shaft and the free end of the hub are oriented in the same axial direction. The outer surface of the hub is radially outwardly spaced from the bore and the blades are mounted to outer surface of the hub at uniform angular spacings therearound and project radially outwardly therefrom. The exhauster fan assembly also includes a hub protector assembly having a plate and plate connector means for connecting the plate to at least one of the free end of the shaft and the free end of the hub. The plate has an outer periphery each point of which is at a greater radial spacing from the shaft rotational axis than a corresponding angularly aligned point on the outer surface of the hub, whereby the plate fully radially overlies the hub and the shaft to which it is attached, as viewed along the shaft rotational axis.

According to one feature of the exhauster of the present invention, the shaft has an externally threaded end portion and the plate connector means includes a ring element having an internally threaded bore compatibly configured with the externally threaded end portion of the shaft for threading engagement thereof.

According to an alternate feature of the exhauster of the present invention, the plate connector means includes a pair of bolts securable to the plate and the hub includes a pair of bolt receiving holes for receiving the bolts therein to thereby secure the plate to the hub.

The plate is preferably covered by a flat surfaced element, which is in the form of a ceramic lined wear plate, which advantageously discourages the occurrence of turbulence or eddy effects of the incoming coal stream, in contrast to the turbulence promoting effect of the non-planar, angle "cooley cap" protectors of the prior art which tend to set up a flow pattern causing localized wear at the leading edges of the fan blades.

DESCRIPTION OF THE PREFERRED EMBODIMENT

Figure 1:
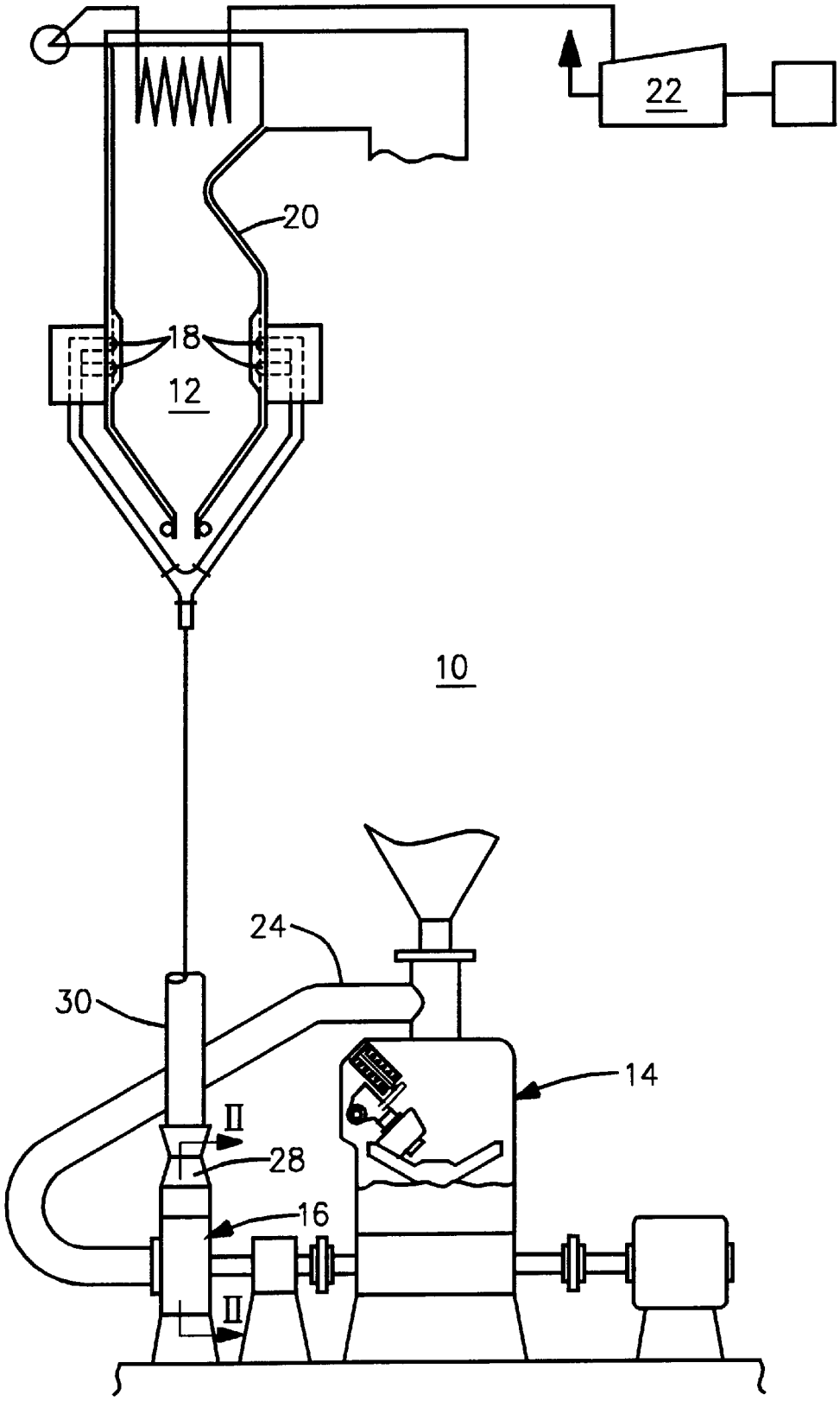
FIG. 1 is a schematic representation of a solid fuel pulverizer firing system embodying an exhauster constructed in accordance with the present invention.

Referring now to the drawing, and more particularly to FIG. 1 thereof, there is depicted therein that portion of a solid fuel pulverizer firing system 10 which comprises a furnace 12, a pulverizer 14, and an exhauster 16, for effecting delivery of a mixture of hot gases and entrained fine solid fuel particles from the pulverizer 14 to the furnace 12. Inasmuch as the nature of the construction and the mode of operation of solid fuel pulverizer firing systems per se are well-known to those skilled in the art, it is not deemed necessary, therefore, to set forth herein a detailed description of the solid fuel pulverizer firing system 10. Rather, for purposes of obtaining an understanding of a solid fuel pulverizer firing system which is capable of having cooperatively associated therewith an exhauster of the present invention such as the exhauster 16, reference is had to the more detailed description of the nature of the construction and the mode of operation of the components of a solid fuel pulverizer firing system disclosed in U.S. Pat. No. 3,205,843, which issued Sep. 14, 1965 to A. Bogot.

Considering first the furnace 12, it is within the furnace 12 that in a manner well-known to those skilled in this art combustion of the pulverized solid fuel and air is initiated. To this end, the pulverized solid fuel and air is injected into the furnace 12 through a plurality of burners, which are schematically depicted at 18 in FIG. 1 of the drawing. In addition to the aforementioned pulverized solid fuel and air, there is also supplied to the furnace 12 the secondary air which is required to effectuate the combustion within the furnace 12 of the pulverized solid fuel that is injected thereinto through the burners 18.

The hot gases that are produced from construction of the pulverized solid fuel and air rise upwardly in the furnace 12. During the upwardly movement thereof in the furnace 12, the hot gases in a manner well-known to those skilled in this art give up heat to the fluid passing through the tubes, which are schematically depicted at 20 in FIG. 1, that in conventional fashion line all four of the walls of the furnace 12. Then, the hot gases exit the furnace 12 through a horizontal pass which in turn leads to a rear gas pass, both gas passes commonly comprising other heat exchanger surface (not shown) for generating and super heating steam, in a manner well-known to those skilled in this art. Thereafter, the steam commonly is made to flow to a turbine, generally designated by the reference numeral 22 in FIG. 1, which is in turn connected to a variable load, such as an electric generator (not shown), which in known fashion is cooperatively associated with the turbine 22, such that electricity is thus produced from the generator (not shown).

Figure 2:
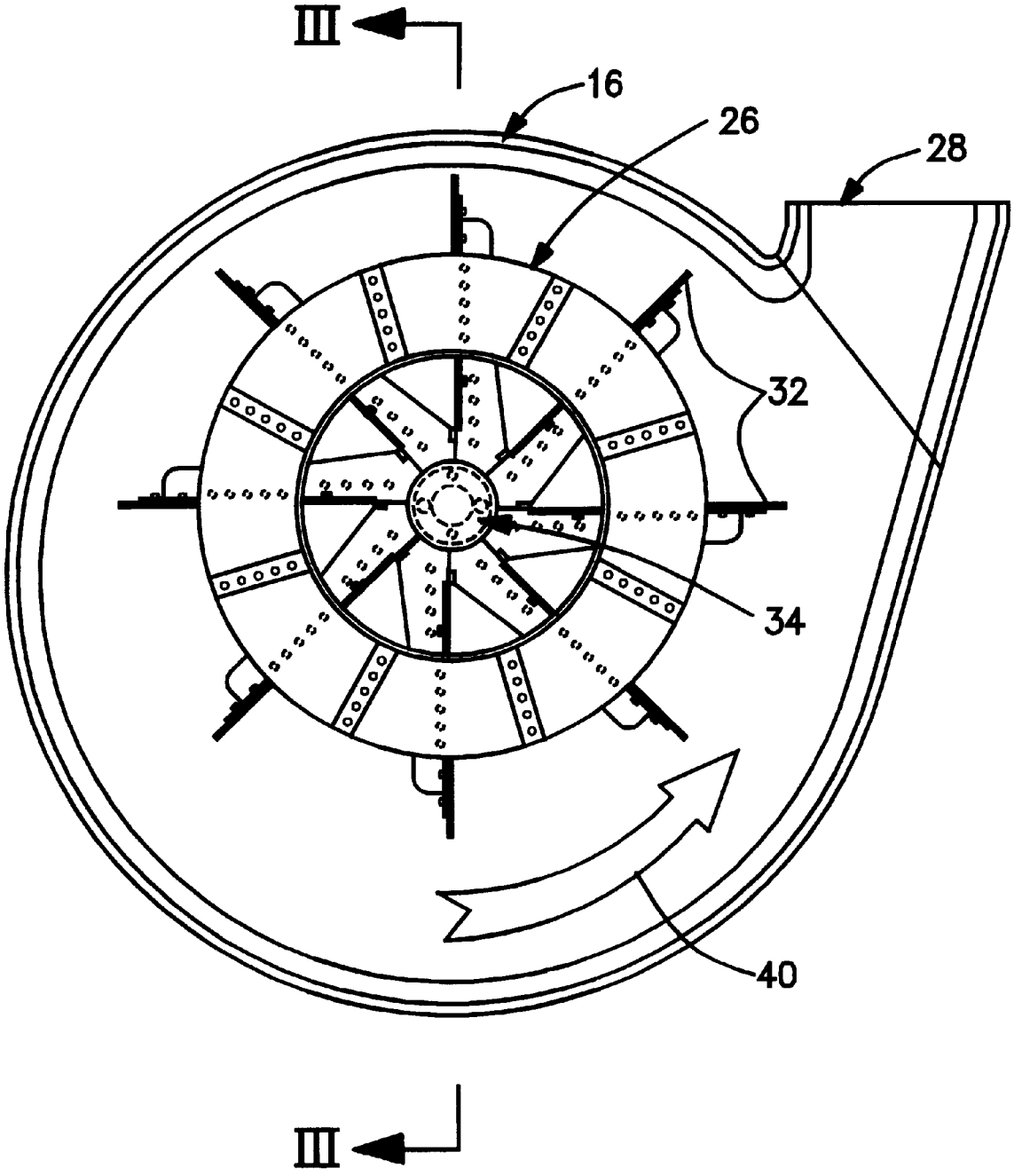
FIG. 2 is an enlarged front elevational view, in vertical section, of the exhauster of the solid fuel pulverizer firing system shown in FIG. 1, taken along lines II—II thereof.

A description will next be had herein of the mode of operation of the solid fuel pulverizer firing system 10 illustrated in FIG. 1 of the drawing. To this end, solid fuel is supplied to and is pulverized within the pulverizer 14. In turn, the pulverizer 14 is connected by means of a duct 24 to the exhauster 16 whereby the solid fuel that is pulverized within the pulverizer 14 is entrained therewithin in an airstream and while so entrained therein is conveyed from the pulverizer 14 through the duct 24 to the exhauster 16. With reference now to FIG. 2, which is a front elevational sectional view of the exhauster 16, it can be seen that the airstream with the pulverized solid fuel entrained therewith is made to pass through the exhauster 16 by virtue of the movement of an exhauster fan assembly 26. The pulverized solid fuel while still entrained in the airstream is discharged from the exhauster 16 through an outlet 28. From the exhauster 16 the pulverized solid fuel entrained in the airstream is conveyed to the furnace 12 through the duct denoted in the drawing by reference numeral 30 in FIG. 1, whereupon the pulverized solid fuel is combusted within the furnace 12.

Figure 3:
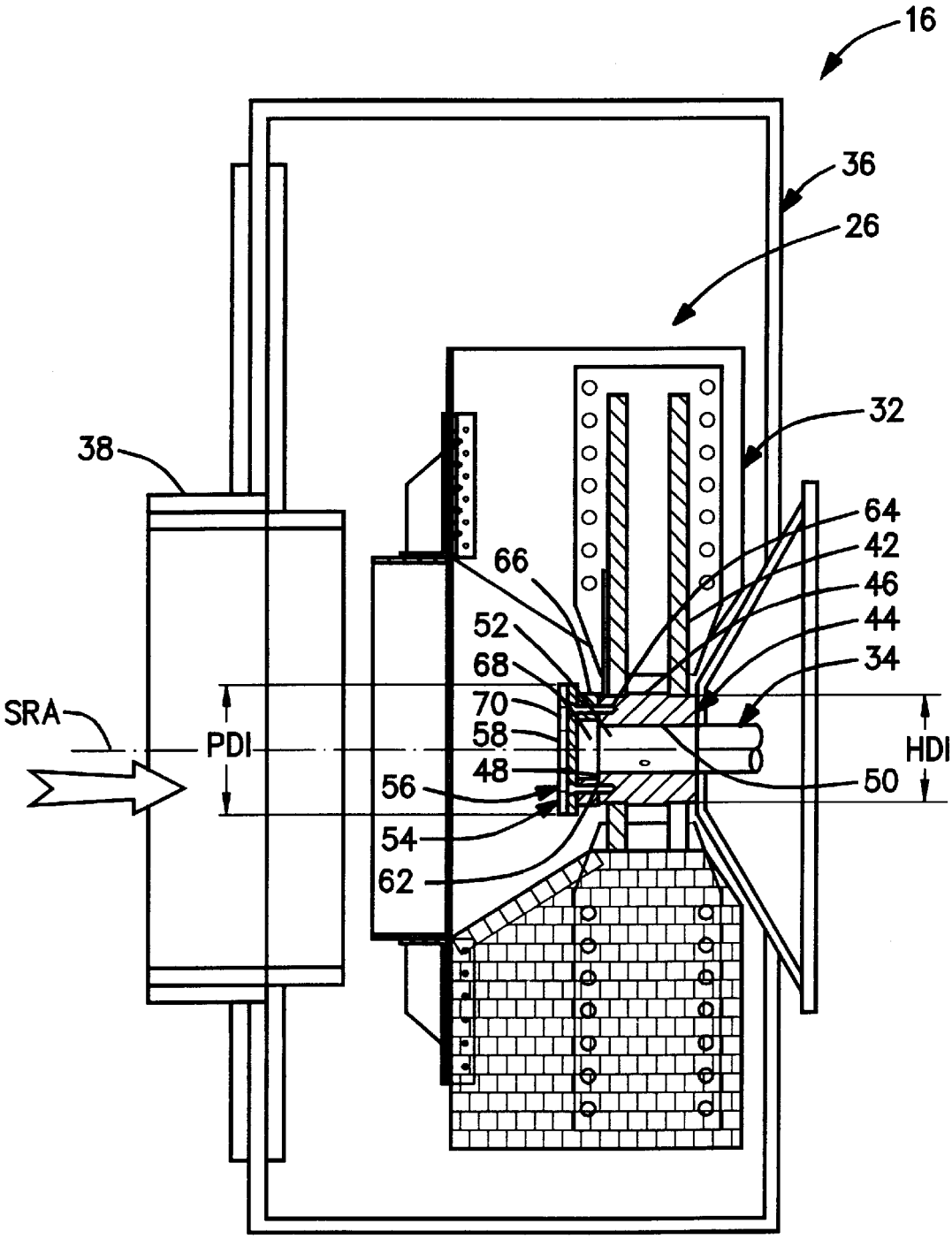
FIG. 3 is an enlarged side elevational sectional view of the exhauster, taken along lines III—III of FIG. 2.
Figure 4:
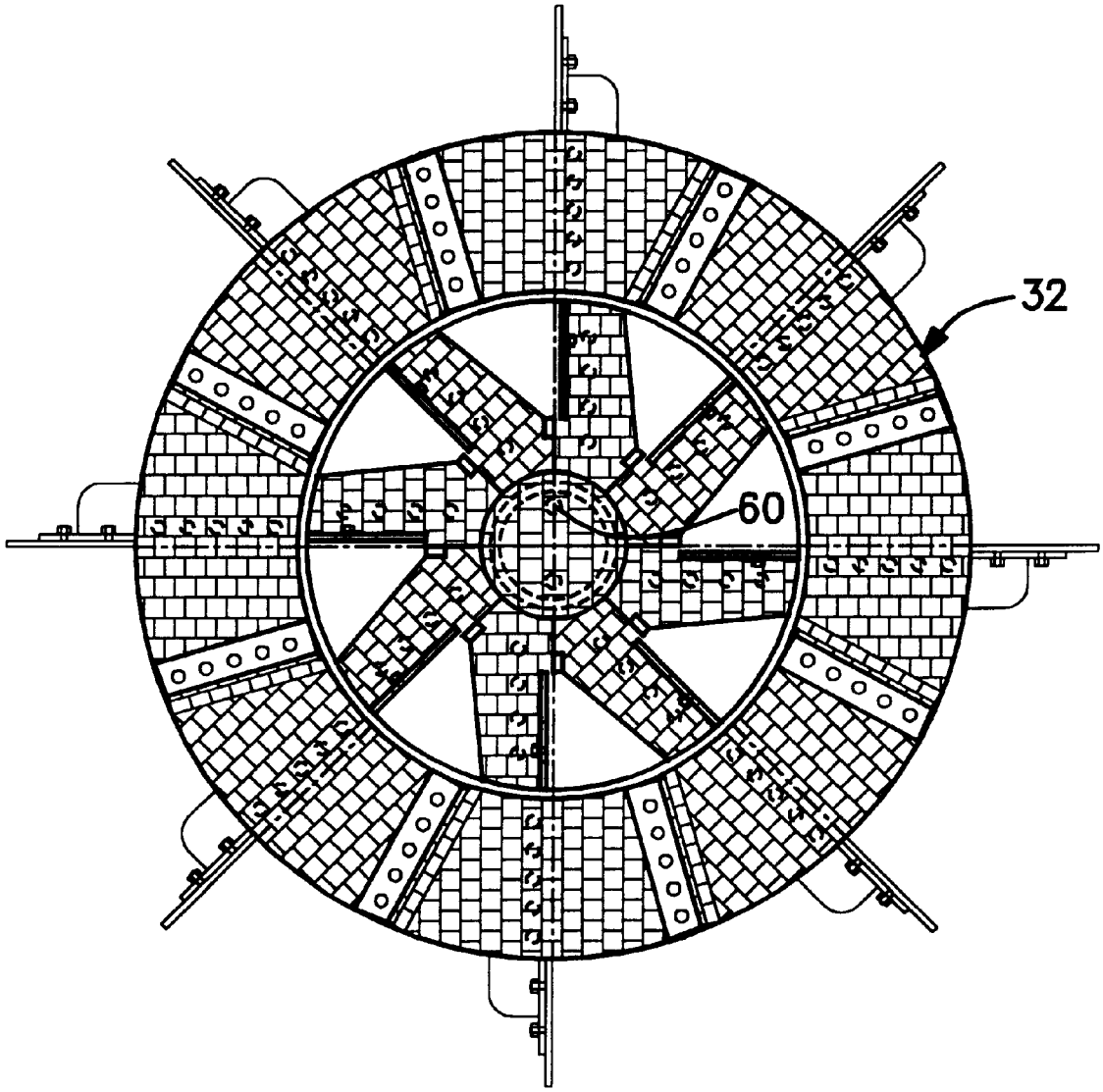
FIG. 4 is a front elevational sectional view of the exhauster fan assembly of the exhauster shown in FIG. 3.

A more detailed description of the exhauster fan assembly 26 now follows with reference to FIG. 3, which is an enlarged side elevational sectional view of the exhauster 16 showing the exhauster fan assembly 26 thereof, and FIG. 4, which is an enlarged front elevational view of the exhauster fan assembly 26. The exhauster fan assembly 26 includes a fan 32 mounted on a shaft 34 for rotation of the fan about a shaft rotational axis SRA. The fan 32 rotates within a housing 36 which has an inlet 38 communicated with the duct 24 and generally aligned with the shaft rotational axis SRA such that coal entering the housing 36 through the inlet 38 contacts the rotating exhauster fan 32 and is redirected thereby along a radial outlet path, denoted by the arrow 40 in FIG. 2.

The exhauster fan 32 includes a plurality of blades 42 and a hub 44. The hub 44 has an outer surface 46, a free end 48, and a bore 50 for receiving therein the free end 52 of the shaft 34 in an orientation in which the free end 52 of the shaft 34 and the free end 48 of the hub 44 are oriented in the same axial direction relative to the shaft rotational axis SRA. The outer surface 46 of the hub 44 is radially outwardly spaced from the bore 50 of the hub 44 and the blades 32 are mounted to outer surface 46 of the hub 44 at uniform angular spacings therearound and project radially outwardly therefrom.

The exhauster fan assembly 26 also includes a hub protector sub-assembly 54 having a wear plate 56 and plate connector means for connecting the wear plate 56 to at least one of the free end 52 of the shaft 34 and the free end 48 of the hub 44—in other words, the wear plate 56 can be connected by the plate connector means to either the free end 52 of the shaft 34 or the free end 48 of the hub 44, depending upon the design choice. In the embodiment of the exhauster fan assembly 26 shown in FIGS. 3 and 4, the plate connector means connects the wear plate 56 to the free end 48 of the hub 44. The wear plate 56 has an outer periphery 58 which is preferably of an annular shape and each point of the outer periphery 58 is at a greater radial spacing from the shaft rotational axis SRA than a corresponding angularly aligned point on the outer surface 46 of the hub 44, whereby the wear plate 56 fully radially overlies the hub 44 and the shaft 34, as viewed along the shaft rotational axis SRA. For example, as seen in FIG. 3, the diameter PDI of the plate 56 is greater than the outer diameter HDI of the hub 44.

Figure 5:
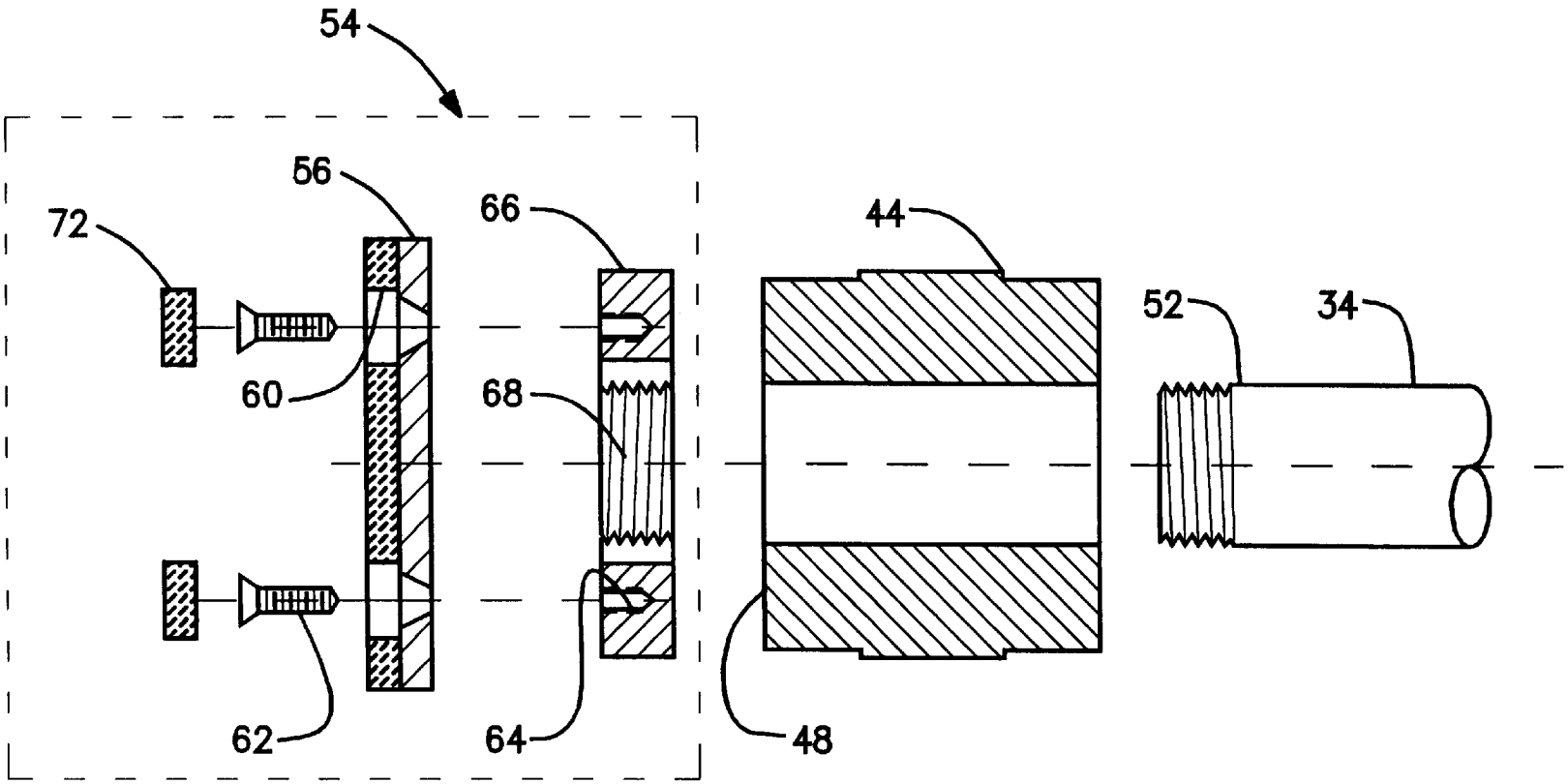
FIG. 5 is an exploded side elevational view, in vertical section, of a variation of the hub protector sub assembly of the exhauster of the present invention.

As seen in FIG. 5, the wear plate 56 of the hub protector sub-assembly 54, in one variation thereof, includes a pair of diametrically opposed throughbores 60 angularly spaced from one another. A bolt 62 is inserted in each throughbore 60 and the threaded free end of the bolt is threadingly received in a respective one of a pair of correspondingly threaded tap bores 64 formed in a cylindrical spacer 66. The cylindrical spacer 66 has a threaded center bore 68 for threadingly receiving the threaded free end 52 of the shaft 34. The cylindrical spacer 66 serves to retain the wear plate 56 at an axial spacing from the free end 48 of the hub.

The wear plate 56 is preferably in the form of a carbon steel disc that is lined with vacuum bonded ceramics. A pair of ceramic discs 72 cover the heads of the bolts securing the wear plate 56 to the spacer 66.

Figure 6:
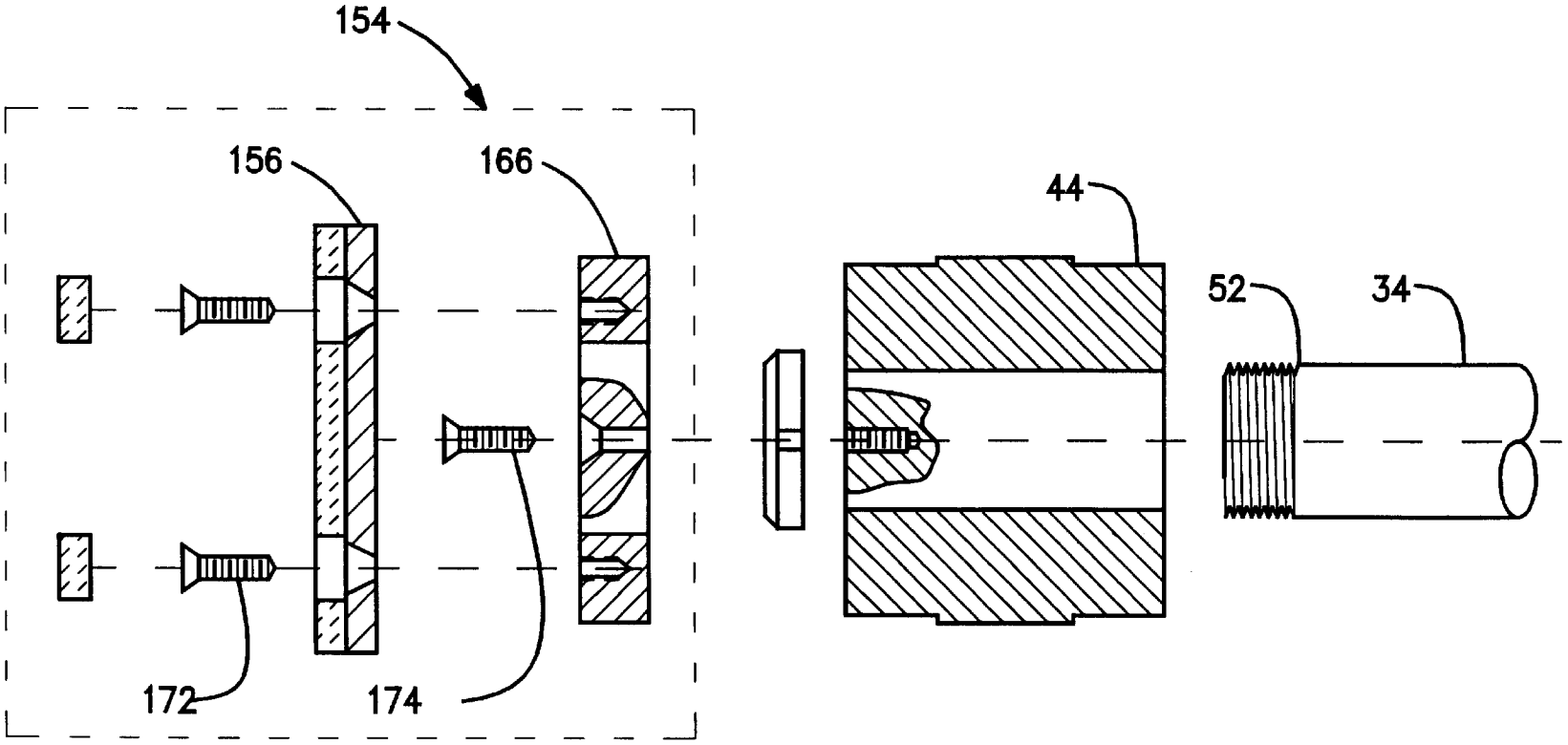
FIG. 6 is an exploded side elevational view, in vertical section, of another variation of the hub protector sub assembly of the exhauster of the present invention

Reference is now had to FIG. 6 which is an exploded side sectional elevational view of another variation or alternate feature of the hub protector sub assembly of the exhauster of the present invention. This variation of the hub protector sub assembly, denoted by the reference numeral 154, includes a wear plate 156 preferably in the form of a carbon steel disc that is lined with vacuum bonded ceramics and which is secured to the spacer 166 by a pair of screws 172. The hub protector sub assembly 154 also includes an annular spacer 166. The annular spacer 166 is secured to the free end of the hub 44 by a pair of bolts 174 which are threadingly received in corresponding threaded bores in the hub 44. The hub protector sub assembly 54 of the one variation shown in FIG. 5 thus provides both a wear protection function as well as a retaining function in which it retains the fan 32 on the shaft 34. The hub protector sub assembly of the other variation shown in FIG. 6 provides a wear protection function while a conventional lock nut secures the fan to the shaft.

While there has been illustrated and described herein a preferred embodiment of the invention, it is to be understood that such is merely illustrative and not restrictive and that variations and modifications may be made therein without departing from the spirit and scope of the invention. It is, therefore, intend by the appended claims to cover the modifications alluded to herein as well as the other modifications which fall within the true spirit and scope of the invention.

What is claimed is:

1. An exhauster for a pulverized solid fuel firing system, comprising:

a housing;

a fan for exhausting coal through an exhauster fan housing, the exhauster fan being mountable within the housing on a shaft for rotation about a shaft rotational axis and the housing having an inlet generally aligned with the shaft rotational axis such that coal entering the housing through the inlet contacts the rotating exhauster fan and is redirected thereby along a radial outlet path, the exhauster fan including a plurality of blades;

a hub having an outer surface, a free end, and a bore for receiving therein the free end of the shaft in an orientation in which the free end of the shaft and the free end of the hub are oriented in the same axial direction, the outer surface of the hub being radially outwardly spaced from the bore and the blades being mounted to outer surface of the hub at uniform angular spacings therearound and projecting radially outwardly therefrom; and a hub protector assembly having a wear plate and wear plate connector means for connecting the plate to at least one of the free end of the shaft and the free end of the hub, the plate having an outer periphery each point of which is at a greater radial spacing from the shaft rotational axis than a corresponding angularly aligned point on the outer surface of the hub, whereby the plate fully radially overlies the hub and the shaft to which it is attached, as viewed along the shaft rotational axis; and wherein the shaft has an externally threaded end portion and the wear plate connector means includes a ring element having an internally threaded bore compatibly configured with the externally threaded end portion of the shaft for threaded engagement thereof.

* * * * *